US005834884A

United States Patent [19]

Roberts et al.

[11] Patent Number: 5,834,884

[45] Date of Patent: Nov. 10, 1998

[54] SYSTEMATIC CONFIGURATION OF COMPACT FLUORESCENT LAMPS FOR OPERATION IN A SINGLE-TYPE BALLAST

[75] Inventors: Victor David Roberts, Burnt Hills, N.Y.; Clarence James Harsa, Broadview Heights, Ohio; David Joseph Kachmarik, Strongsville, Ohio; Spiro Vamvakas, Rockey River, Ohio

[73] Assignee: General Electric Company, Schenectady, N.Y.

[21] Appl. No.: 774,046

[22] Filed: Dec. 23, 1996

[51] Int. Cl.[6] ..... H01J 5/48; H01J 5/50

[52] U.S. Cl. ..... 313/318.01; 313/318.02; 439/611; 439/612; 439/620; 315/87; 315/307

[58] Field of Search ..... 313/318.02, 318.01, 313/318.06, 318.12, 318.07; 439/611, 612, 614, 620; 315/307, 70, 76, 87, 92

[56] References Cited

U.S. PATENT DOCUMENTS

| | | | |
|---|---|---|---|
| 3,753,027 | 8/1973 | Kolkman | 313/318.02 |
| 4,623,823 | 11/1986 | Engel . | |
| 4,695,767 | 9/1987 | Wittmann . | |
| 5,175,474 | 12/1992 | Kakitani et al. . | |
| 5,341,068 | 8/1994 | Nerone . | |
| 5,345,142 | 9/1994 | Chamberlain et al. . | |
| 5,406,177 | 4/1995 | Nerone . | |

FOREIGN PATENT DOCUMENTS

| | | |
|---|---|---|
| 0221864 | 3/1986 | European Pat. Off. . |

*Primary Examiner*—Nimeshkumar Patel
*Attorney, Agent, or Firm*—Jill M. Breedlove; Douglas E. Stoner

[57] ABSTRACT

A systematic configuration of compact fluorescent lamps of different power levels determines the operating parameters for normal operation of each respective lamp in a single-type ballast.

4 Claims, 4 Drawing Sheets

SYSTEMATIC CONFIGURATION OF COMPACT FLUORESCENT LAMPS FOR OPERATION IN A SINGLE-TYPE BALLAST

FIELD OF THE INVENTION

The present invention relates generally to compact fluorescent lamps and, more particularly, to a systematic configuration of compact fluorescent lamps of different power levels for normal operation of each particular lamp in a single-type ballast.

BACKGROUND OF THE INVENTION

Many compact fluorescent lamps have one or more generally U-shaped tubular envelopes. There are also helix-shaped compact fluorescent lamps and electrodeless compact fluorescent lamps. Presently available compact fluorescent lamps have inputs of at least 55 Watts.

There are three general types of compact fluorescent lamps (CFL's) as follows: (1) plug-in CFL's, including a lamp and possibly a starter, designed to plug into a fixture that includes a permanently wired ballast; (2) integral CFL's, including a lamp and ballast which are permanently connected with a base (e.g., Edison) mounted on one end so that the complete assembly can be used in a socket designed for an incandescent lamp; and (3) adapter CFL's, including an adapter which contains the ballast, the adapter having a socket on one end to accept a plug-in CFL and a base on the other end so that it can be used in a socket designed for an incandescent lamp.

Presently, in the manufacture of CFL's, it is common for each different lamp design to be coupled to a unique ballast which is designed to match the electrical characteristics of that lamp. Disadvantageously, this requires the manufacture and stocking of a wide variety of ballasts.

Accordingly, it is desirable to use a single-type ballast for operating different types of CFL's, i.e., CFL's of different power levels, thereby simplifying the manufacturing requirements for CFL's and hence reducing cost.

SUMMARY OF THE INVENTION

Each respective lead of compact fluorescent lamps of different power levels is oriented in a predetermined position, depending on the power level of the lamp, such that, upon connection to the ballast, the positions of the respective leads determine the operating conditions for each respective ballast and lamp combination. Advantageously, therefore, different compact fluorescent lamps may be used in a single-type ballast which modifies its operating parameters based on its identification of the lamp plugged therein.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
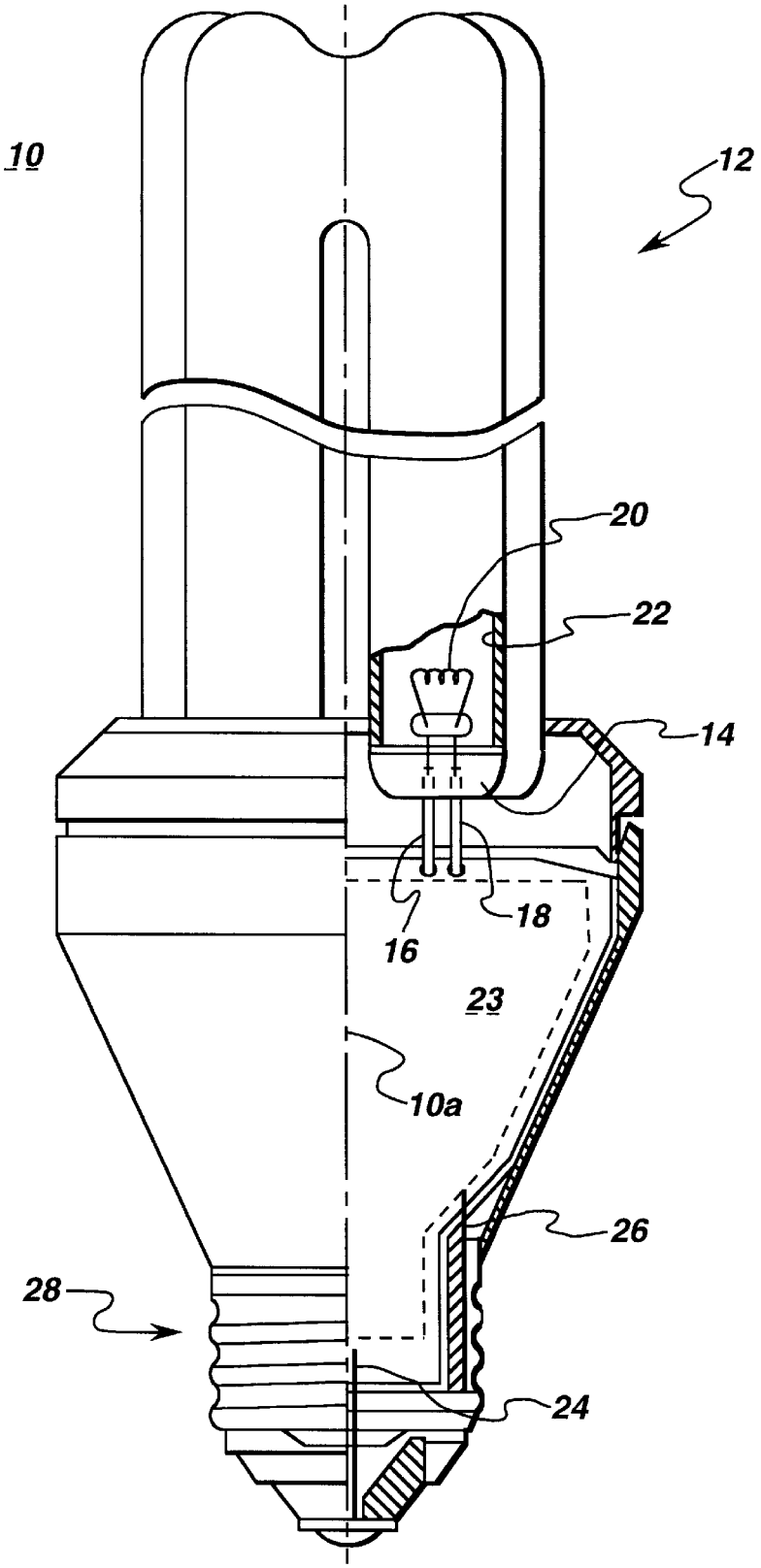
fig. 1 PRIOR ART
FIG. 1 is a side view, partially in cross section, illustrating a conventional compact fluorescent lamp of the type having multiple U-shaped tubular portions.

FIG. 1 illustrates a low-pressure discharge lamp 10 according to the present invention shown as a compact fluorescent lamp. Lamp 10 includes a discharge tube 12 having multiple U-shaped tubular portions made from a translucent material. The discharge tube contains a fill comprising mercury and at least one noble gas. The discharge tube is sealed in a gas-tight manner by pinch-sealed portions 14 that support electrode leads 16 and 18 which, in turn, support electrodes 20. A phosphor layer 22 is applied to the inner surface of the discharge tube for converting ultraviolet radiation, which is generated by excitation of the fill, into visible light.

Figure 2:
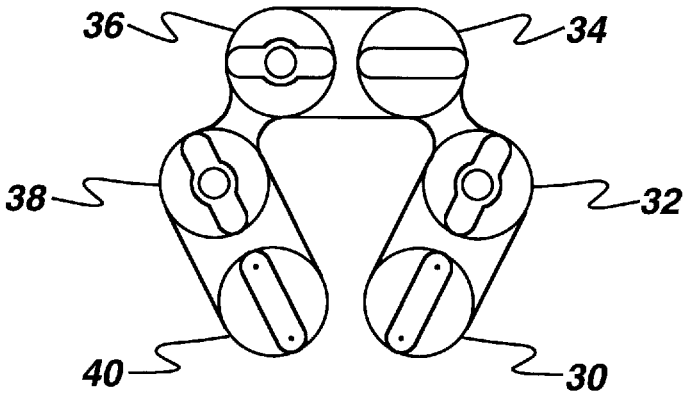
FIG. 2 is a bottom view of the discharge tube of the lamp of FIG. 1.

By way of illustration, the discharge tube of FIG. 1 is shown as having three U-shaped tubular sections, two ends of which have electrodes for plugging into a ballast which is represented in FIG. 1 by dashed lines 23. A suitable ballast for a compact fluorescent lamp is described in U.S. Pat. No. 5,175,474, issued Dec. 29, 1992, which is incorporated by reference herein. Lead-in wires 24 and 26 connect electrodes 20 through the ballast to a threaded base 28, e.g., an Edison base. Two of the pinch-sealed ends each support two electrode leads 16 and 18 per electrode. FIG. 2 is a bottom view of the discharge tube showing ends 30, 32, 34, 36, 38 and 40, with ends 30 and 40 comprising electrode ends, each electrode end supporting two electrode leads 16 and 18.

In accordance with the present invention, each respective lead of each lamp corresponding to a different power level is oriented in a predetermined position, depending on the designed power level of the lamp, such that, upon connection to the ballast, the positions of the respective leads determine the operating conditions for the respective ballast and lamp combination.

Figure 3:
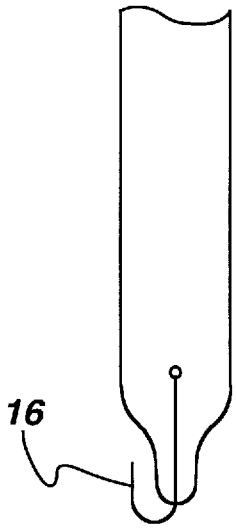
FIGS. 3, 4 and 5 are side views illustrating configurations of electrode leads for identification of particular types of compact fluorescent lamps by a single-type ballast in accordance with the present invention.
Figure 4:
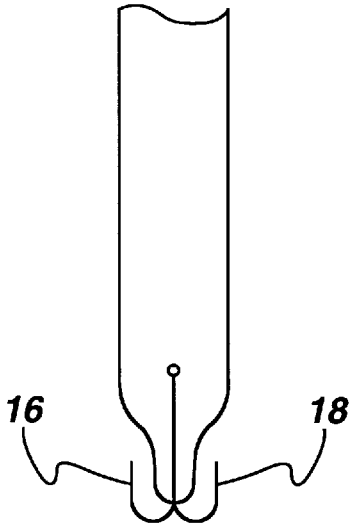
Figure 5:
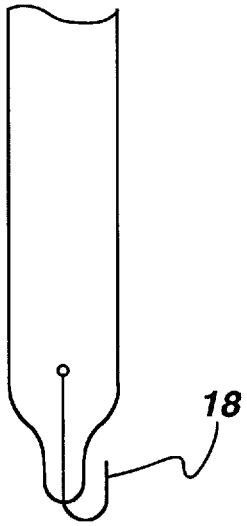
Figure 6:
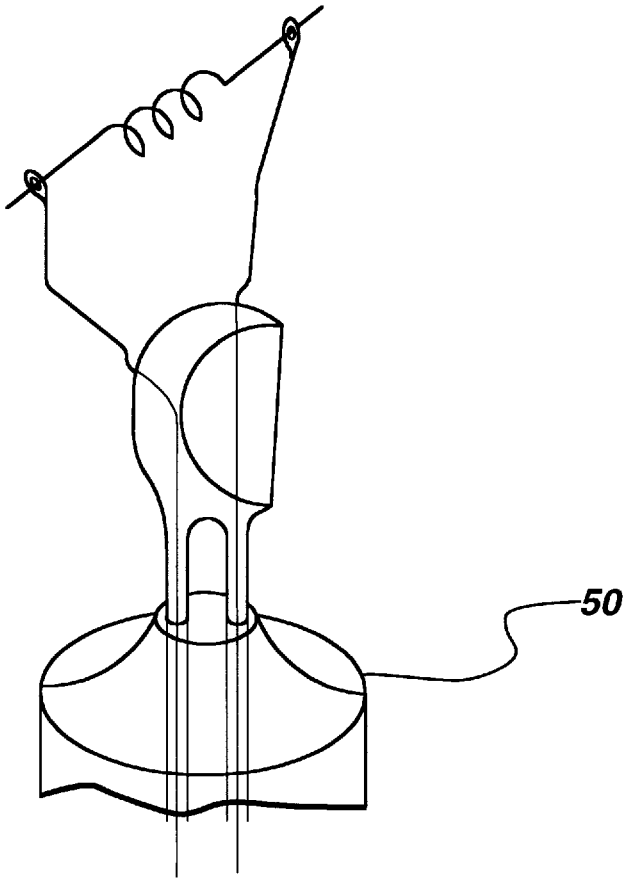
FIG. 6 illustrates a flared mount for a fluorescent lamp.

FIGS. 3, 4 and 5 show how different compact fluorescent lamps, i.e., of different power levels, are "coded" according to the present invention for identification by the ballast into which they are plugged such that the ballast modifies its operating parameters for each respective ballast and lamp combination. In particular, FIG. 3 shows electrode leads 16 and 18 bent upward in one location on the discharge tube; FIG. 4 shows electrode leads bent upward 180° apart on the tube; and FIG. 5 shows electrode leads bent upward in another location on the tube. Given two possible electrode positions for each of the four electrode leads, there are sixteen unique "codes" for appropriate lamp identification by the ballast. Of course, for tubes having a flared mount to which the lamp bulb is sealed, such as illustrated in FIG. 6, more positions, and hence more codes for identification, are possible. In fact, an infinite number of positions are possible around the sealed circular portion 50 of the flared mount. In addition, for well-known instant-start compact fluorescent lamps which only require one electrode on each end of the discharge tube, one lead is not used (or is cut off), leading to an additional eight codes for lamp identification purposes.

In a ballast such as of a type described in U.S. Pat. No. 5,175,474, cited hereinabove, one method for identification of the lamp inserted therein is to use a tapped ballast inductor. The particular orientations of electrode leads determine which terminals of the tapped inductor will make contact therewith and hence determine the operating conditions for the particular lamp and ballast combination.

Figure 7:
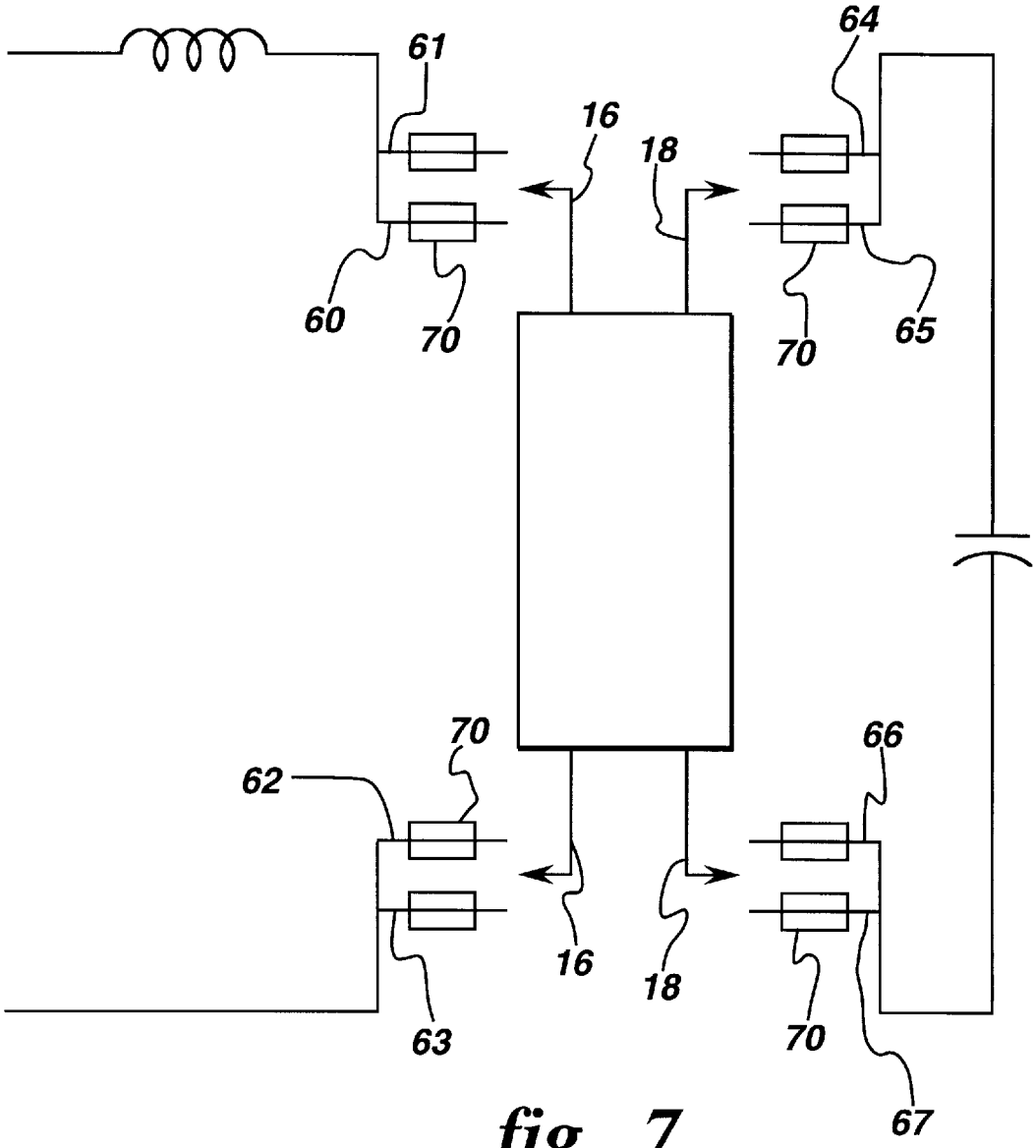
FIG. 7 illustrates the output circuit of a ballast of a type having an integrated circuit control employing the lamp identification scheme of the present invention.

For integrated circuit, i.e., "smart", ballasts, a method for identification of a lamp inserted therein is illustrated in FIG. 7. In particular, the four electrode leads are adapted for attachment to four of eight terminals 60–67 in the ballast output circuit. Each of the eight terminals has a current sensor 70, such as a Hall effect device or a current sensing transformer or other suitable current sensing device. The operating conditions for the particular lamp and ballast configuration are determined by which current sensors sense current and ,hence, by the particular orientation of the lamp's electrode leads.

The invention herein is applicable to wedge-type or flare-type bases and also to other suitable bases, such as of a conventional incandescent lamp-type having wire leads plugged into a brass pin. To employ the present invention in such an incandescent lamp-type base, such a base would require eight pins (i.e., for the particular lamp configuration having four electrode leads as described hereinabove.)

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A low-pressure discharge lamp, comprising:

at least one discharge tube containing a fill for sustaining a discharge therein, the discharge tube being sealed in a gas-tight manner and having two electrode leads at each end thereof, each electrode lead being oriented in a predetermined position depending upon the power level of the lamp such that, upon connection to a ballast, the positions of the respective leads determine the operating conditions for the respective ballast and lamp combination.

2. The lamp of claim 1, comprising two positions for orientation of each electrode lead such that the ballast may operate twenty-eight types of lamps, each type corresponding to a different power level.

3. The lamp of claim 2 wherein the discharge tube has a circular cross section, the two positions being situated 180° apart.

4. The lamp of claim 1 comprising a compact fluorescent lamp, the discharge tube having an inner phosphor coating.

* * * * *